United States Patent [19]

Abe

[11] Patent Number: 4,819,028

[45] Date of Patent: Apr. 4, 1989

[54] ELECTROPHOTOGRAPHIC RECORDING APPARATUS FOR FORMING A MULTICOLOR IMAGE

[75] Inventor: Hideaki Abe, Tokyo, Japan

[73] Assignee: NEC Corporation, Tokyo, Japan

[21] Appl. No.: 105,754

[22] Filed: Oct. 8, 1987

[30] Foreign Application Priority Data

Oct. 8, 1986 [JP] Japan ..... 61-239990

[51] Int. Cl.[4] ..... G03G 15/01

[52] U.S. Cl. ..... 355/4; 355/14 D; 355/3 DD; 355/77

[58] Field of Search ..... 355/4, 3 CH, 14 CH, 355/77, 3 DD, 14 D; 430/42–44; 346/153.1, 157

[56] References Cited

U.S. PATENT DOCUMENTS 4,660,059 4/1987 O'Brien ..... 346/157

4,660,961 4/1987 Kuramoto et al. ..... 355/4

*Primary Examiner*—R. L. Moses

*Attorney, Agent, or Firm*—Sughrue, Mion, Zinn, Macpeak and Seas

[57] ABSTRACT

A electrophotographic recording apparatus capable of forming a clear multicolor image including a first visible image of a first color and a second visible image of a second color on a photoconductive drum. The electrophotographic recording apparatus is provided with a conventional charger unit and a second charger unit for charging a surface of the photoconductive drum after the first visible image is formed thereon so as to increase the surface potential of the photoconductive drum to prevent the first visible image from being mixed with a second color and scratched off from the surface of the photoconductive drum by a second developing unit.

9 Claims, 4 Drawing Sheets

(AFTER 1st CHARGE)

(AFTER 1st EXPOSURE)

(AFTER 1st DEVELOPMENT)

(AFTER 2nd CHARGE)

(AFTER 2nd EXPOSURE)

(AFTER 2nd DEVELOPMENT)

(AFTER PRE-TRANSFER ERASE)

(AFTER MAIN ERASE)

ELECTROPHOTOGRAPHIC RECORDING APPARATUS FOR FORMING A MULTICOLOR IMAGE

BACKGROUND OF THE INVENTION

The present invention relates to an electrophotographic recording apparatus which forms a multicolor image on a surfac e of a photoconductive drum and then transfers the multicolor image to recording paper.

A conventional electrophotographic recording apparatus includes a photoconductive drum around which a corona charger, a first exposure unit, a first developing unit, a second exposure unit, a second developing unit and a transfer unit are disposed, as disclosed in U.S. Pat. No. 4,572,651. In operation, the surface of the photoconductive drum is first uniformly charged by the corona charger and then exposed by the first exposure unit to form a first electrostatic latent image. The first electrostatic latent image is developed with a toner of a first color by the first developing unit. Thus, a first visible image of the first color is formed on the surface of the photoconductive drum. Next, the surface of the photoconductive drum is exposed by the second exposure unit to form a second electrostatic latent image which is then developed by the second developing unit with a toner of a second color different from the first color to form a second visible image. Thus, both the first and second visible images of the first and second colors are formed on the photoconductive drum surface and are simultaneously transferred to a recording paper web by the transfer unit.

In order to prevent the first visible image from being scratched off from the surface of the photoconductive drum by the second developing unit, the first developing unit enables the toner of the first color to have a larger electric charge than the toner of the second color in the second developing unit so that the first visible image strongly adheres to the surface of the photoconductive drum.

In the conventional apparatus, however, the toner of the second color is apt to adhere to the surface of the second, as well as the first electrostatic latent image, which should be developed only with the toner of the first color, because of the remaining electrostatic force of the first latent image. Accordingly, the first visible image of the first color is mixed with the second color, thus impairing the production of a clear first visible image.

SUMMARY OF THE INVENTION

Therefore, an object of the present invention is to provide an electrophotographic recording apparatus capable of forming a clear multicolor image, in which a first visible image of a first color is not mixed with a second color and not scratched off from a photoconductive drum when the second visible image of the second color is formed on the drum.

The electrophotographic recording apparatus according to the present invention is provided, in addition to the conventional charger unit, with a second charger unit for charging a surface of the photoconductive drum after the first visible image is formed thereon so as to increase the surface potential of the photoconductive drum to prevent the first visible image from being mixed with a second color and scratched off from the surface of the photoconductive drum by a second developing unit.

DESCRIPTION OF THE PREFERRED EMBODIMENT

Figure 1:
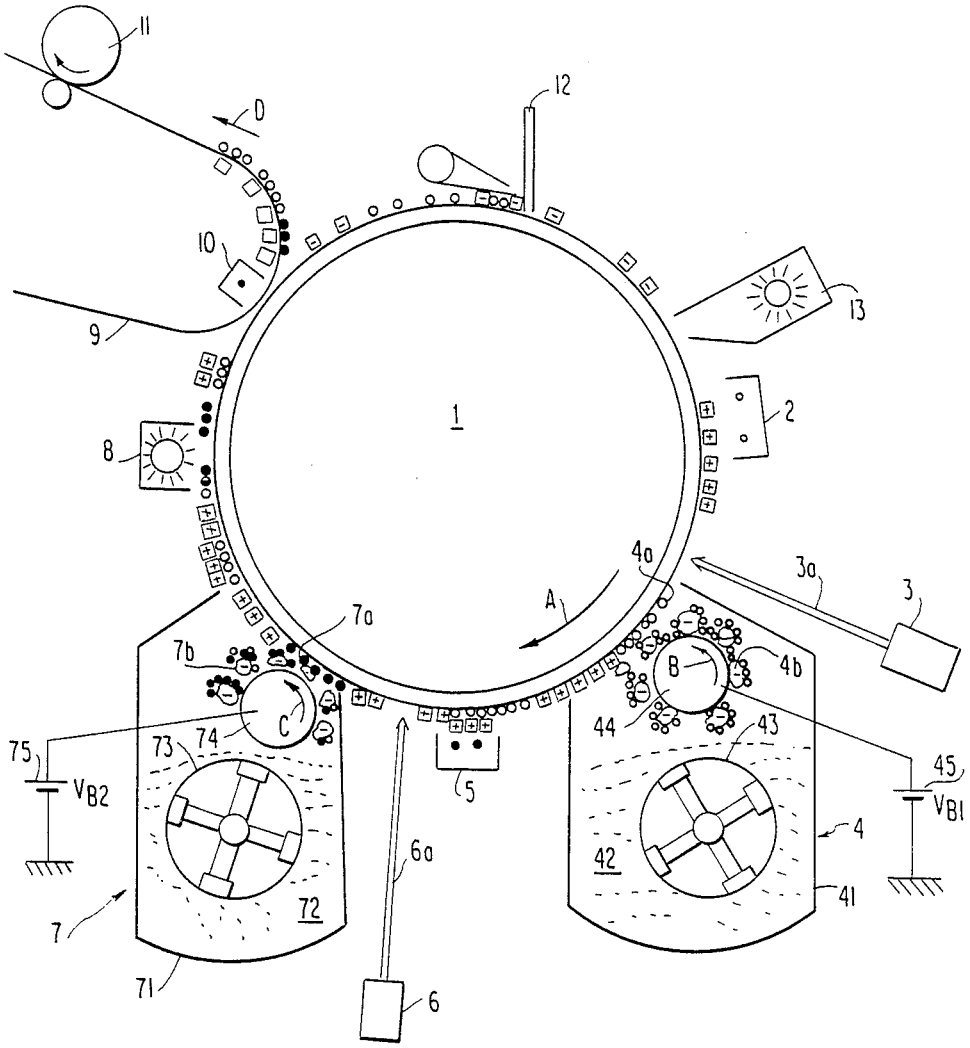
FIG. 1 is a schematic diagram of an electrophotographic recording apparatus according to an embodiment of the present invention.

An electrophotoconductive recording apparatus according to an embodiment of the present invention is schematically shown in FIG. 1, which forms a two-color image of red and black.

A photoconductive drum 1 is rotated in a direction of arrow A at a peripheral speed of about 176 mm/sec. The surface of the photoconductive drum 1 is first uniformly charged with a positive potential by a first corona charger 2. A first exposure unit 3 is disposed downstream of the first corona charger 2 in the direction of rotation of the photoconductive drum 1. The first exposure unit 3 selectively exposes the surface of the photoconductive drum 1 with a first laser beam 3*a* so as to selectively discharge the surface of the drum to form a first electrostatic latent image. Then, the first electrostatic latent image is developed by a developing unit 4 with a red toner 4*a*. The developing unit 4 includes a developer container 41 in which a two-component developer 42, a stirring roller 43 and a developing roller 44 are provided. The stirring roller 43 stirs the developer 42 to charge the red toner 4*a* with a positive potential and a carrier 4*b* potential negative. The developing roller 44 creates a magnetic brush with the developer 42 therearound. In order to supply the toner 4*a* to the surface of the drum 1 at the position where the first latent image is formed, the developing roller 44 is biased by a DC voltage source 45 and is rotated in a direction of arrow B.

A second corona charger 5 is disposed downstream of the first developing unit 4 to further positively charge the surface of the photoconductive drum 1. A second exposure unit 6 then selectively exposes the surface of the drum 1 with a second laser beam 6*a* so as to form a second electrostatic latent image. The second latent image is developed with a black toner 7*a* by a second developing unit 7. The second developing unit 7 includes, similar to the first developing unit 4, a container 71, a two-component developer 72, a stirring roller 73, a developing roller 74 and a DC voltage source 75. The developer 72 consists of the black toner 7*a* and a carrier 7*b*.

A pre-transfer eraser lamp 8 is disposed downstream of the second developing unit 7 to discharge the surface of the photoconductive drum 1 so that only the first and second toner images has a positive charge. Then, the first and second toner images on the drum 1 are transferred to a paper web 9 by a transfer unit 10 which supplies a negative charge to the paper web 9. The paper web 9 is fed in synchronism with the peripheral speed of the drum 1 in a direction of arrow D to a fixing unit 11. A cleaner 12 removes any residual toner remaining on the surface of the photoconductive drum 1. A main eraser lamp 13 then uniformly erases a remaining charge on the surface of the drum 1, thereby completing one recording process.

In the preferred embodiment, a photoconductive layer of the drum 1 is made of amorphous silicon containing at least one element selected from a group consisting of O, B, N and P as disclosed in U.S. Pat. No.4,532,196. The photoconductive layer has a thickness of about 26 to 30 μm, a relative dielectric constant of about 11 to 12, a photo sensitivity in wavelength of 780 nm of about 0.5 $\mu J/cm^2$ and an electrostatic capacitance of about 300 $pF/cm^2$.

Referring to FIGS. 2A to 2H, the surface potential of the photoconductive drum 1 in each recording process will be described hereinafter.

Figure 2A:
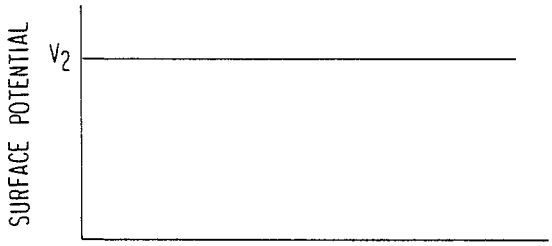
FIGS. 2A to 2H show a surface potential of a surface of a photoconductive drum used in the electrophotographic recording apparatus shown in FIG. 1.
Figure 2B:
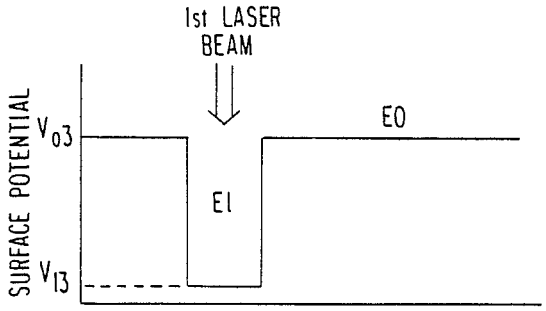

The surface potential of the photoconductive drum 1 is uniformly increased to a value $V_2$ of about 400 V, as shown in FIG. 2A, by applying corona voltage of about 7 KV to the corona (coratron) charger 2. After the exposure by the first laser beam 3a having a wavelength of 780 nm and an exposure energy density of 1.5 $\mu J/cm^2$, which are obtained by a semiconductor laser device, the surface potential of the photoconductive drum 1 is decreased to a value $V_{13}$ of about 5 V at a first exposed area E1, i.e., where the first electrostatic latent image is formed, as shown in FIG. 2B. It is to be noted that the surface potential of a non-exposed area E0 is attenuated to a value $V_{03}$ of about 350 V in proportion to the dark attenuation rate of the photoconductive drum 1.

Figure 2C:
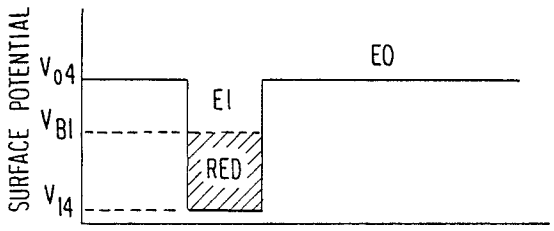

As shown in FIG. 2C, the surface potential $V_{14}$ of the first exposed area E1 is not changed in substance while the potential $V_{04}$ of the non-exposed area E0 is further attenuated to a value of about 280 V at the first developing unit 4. The bias voltage $V_{B1}$ of the developing roller 44 is favorably set at 150 V. Owing to the potential difference between the bias voltage $V_{B1}$ of the developing roller 44 and the surface potential $V_{14}$ of the first exposed area E1, the red toner 4a is attracted and then adhered to the first exposed area E1 by electrostatic force. The red toner 4a is not adhered to the non-exposed area E0 since the surface potential $V_{04}$ thereof is larger than the bias voltage $V_{B1}$. In the first two-component developer 42, the red toner particles have a diameter of 12 μm on an average and an electric charge of 11 to 15 μC/g, and more favorably, of 13 μC/g. A diameter of the carrier 4b is about 40 μm.

Figure 2D:
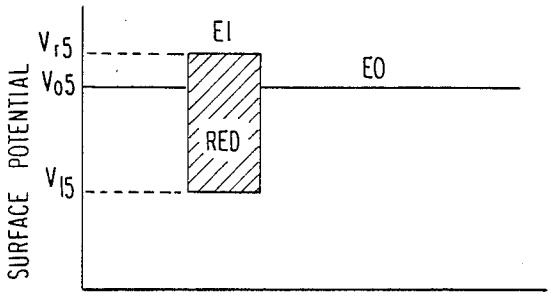

The surface potential of the conductive drum 1 is then increased again as a whole by supplying a corona voltage of about 6 KV to the second corona charger 5 as shown in FIG. 2D. Thus, the surface potential $V_{05}$ of the non-exposed area E0 is increased to about 450 V and the surface potential $V_{15}$ of the first exposed area E1 is to about 180 V. A surface potential $V_{r5}$ of the first toner image is greatly increased to about 530 V due to its small electrostatic capacitance.

Figure 2E:
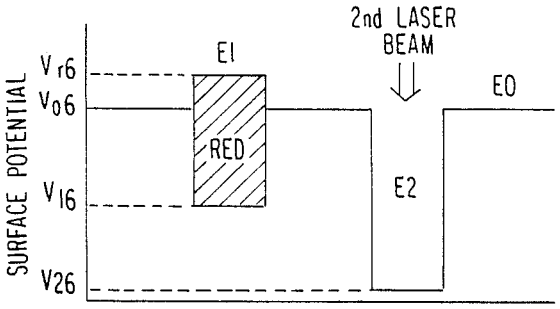

After the second exposure of the second laser beam 6a which has a wavelength of 780 nm and an exposure energy density of 1.5 $\mu J/cm^2$, the surface potential $V_{26}$ of the second exposed area E2, where the second electrostatic latent image is formed, is decreased to about 10 V as shown in FIG. 2E. The potential $V_{06}$ of the non-exposed area E0 is attenuated to about 420 V according to the dark attenuation rate. The potential $V_{16}$ of the first exposed area E1 is attenuated to about 160 V according to a dark attenuation rate of the photoconductive drum 1. The potential $V_{r6}$ of the first toner image is also attenuated to about 510 V.

Figure 2F:
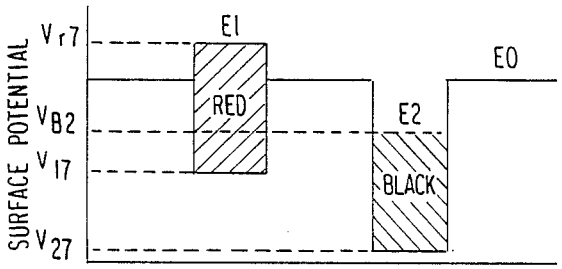

As shown in FIG. 2F, at the portion where the second developing unit 7 is located, the surface potential $V_{07}$ of the non-exposed area E0 becomes about 400 V, the potential $V_{17}$ of the first exposed area E1 becomes about 150 V, the potential $V_{r7}$ of the first toner image becomes 500 V, and the potential $V_{27}$ of the second exposed area E2 is about 10 V. The bias voltage $V_{B2}$ of the developing roller 74 of the second developing unit 7 is set at 250 V. Owing to the potential difference between the bias voltage $V_{B2}$ of the second developing roller 74 and the surface potential $V_{27}$ of the second exposed area E2, the black toner 7a is attracted and then adhered to the second exposed portion E2 formed on the surface of the drum 1. In the second developer 72, the black toner particles favorably have a diameter of 14 μm on an average and an electric charge of 9 to 14 μC/g, and more favorably, of 11 μC/g. A diameter of the carrier 7b is about 40 μm.

Figure 2G:
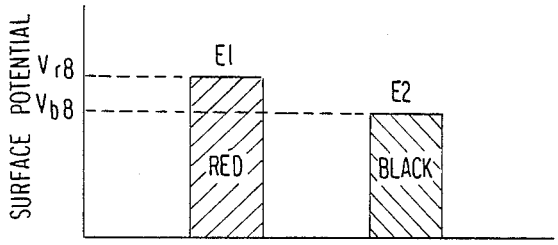

After the second development, the pre-transfer eraser lamp 8 having the exposure energy density of 25 $\mu J/cm^2$ enables the surface potential of the non-exposed area E0 to be nearly "0∞ as shown in FIG. 2G. The positive charge of the red and black images remain on the surface of the drum 1. The potential $V_{r8}$ of the red image is about 350 V and the potential $V_{b8}$ of the black image is about 240 V. The red and black images are transferred to the paper web 9 by the transfer unit 10. The transfer unit 10 is a corona charger which is supplied with a corona voltage of about −6 KV.

Figure 2H:
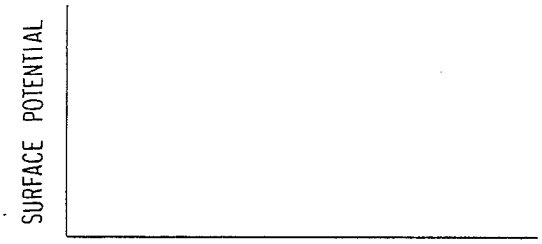

The surface of the photoconductive drum 1 is cleansed by the cleaner 12 and then finally discharged by the main erase lamp 13 whose wavelength is 400 to 800 nm and exposure energy density is 5 $\mu J/cm^2$. The surface potential of the photoconductive drum 1 uniformly becomes 0V as shown in FIG. 2H.

The surface potential $V_{17}$ of the first exposed area E1 during the second development (FIG. 2F) greatly affects the quality of the first toner image, i.e., the red toner image, in relation to the bias voltage $V_{B2}$ of the second developing roller 74. In the case where the surface potential $V_{17}$ is lower than about 120 V, the red toner 4a strongly adheres to the first exposed area E1 of the surface of the photoconductive drum 1 so that the red toner 4a is hardly scratched off by the second magnetic brush created by the second developing roller 74 of the second developing unit 7. However, in this case, the black toner 7a is apt to adhere the first exposed area E1 so that the red toner image is mixed with the black toner 7a since the potential difference between the second bias voltage $V_{B2}$ and the surface potential $V_{17}$ is relatively large. To the contrary, when the surface potential $V_{17}$ is higher than about 190 V, the black toner 7a does not adhere to the first exposed area E1 so as not to be mixed with the red toner image. However, the red toner 4a weakly adheres to the first exposed area E1 with the result that the red toner 4a is easily scratched off from the surface of the drum 1 by the second magnetic brush of the second developing unit 7 and the red toner image is disturbed.

Figure 3:
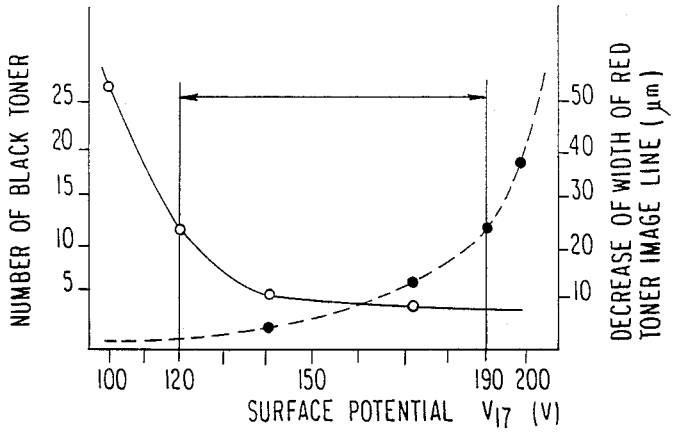
FIG. 3 shows relationship of the surface potential of a first exposed area of the photoconductive drum during a second development with respect to a number of second toner particles mixed with a first toner image and with respect to the amount of the red toner scratched off from the surface of the photoconductive drum by a second developing unit used in the electrophotographic recording apparatus shown in FIG. 1.

FIG. 3 shows the relationships of the surface potential $V_{17}$ of the first exposed area E1 with respect to the amount of the black toner *7a* mixed with the red toner image with respect to and the amount of the red toner scratched off by the second magnetic brush of the second developing unit 7, when the bias voltage $V_{B2}$ is 250 V. In the drawing, a solid line represents a number of black toner particles *7a* adhering to the red toner image within a area of 0.2 mm×1 cm. A broken line represents decrease of a width of a red toner image line scratched off by the second magnetic brush of the second developing unit 7, which line is developed by the first developing unit 4 by a width of 200 μm. When the surface potential $V_{17}$ is higher than the 120 V, the number of black toner *7a* adhering the red toner image is less than 12 pieces, which is permitable in practice. When the surface potential $V_{17}$ is lower than 190 V, the decrease of the red toner line is less than 23 μm, which is permitable in practice. Accordingly, the surface potential $V_{17}$ is favorably in a range from 120 V to 190 V, and more favorably, about 150 V as described in the preferred embodiment. Thus, the favorable range of the surface potential $V_{17}$ of the first exposed area E1 is represented by the bias voltage $V_{B2}$ applied to the second developing roller 74 of the developing unit 7 as follows:

$$0.48V_{B2} \leqq V_{17} \leqq 0.76V_{B2}$$

Additionally, as apparent from FIG. 3, the value of the surface potential $V_{17}$ may be available in practice in a range of $0.4V_{B2} \leqq V_{17} \leqq 0.8V_{B2}$.

The surface potential $V_{17}$ is adjustable in relation to the corona voltage applied to the second corona charger 5, the distance from the second charger 5 to the second developing unit 7 and the dark attenuation rate in the first exposed area E1 of the photoconductive drum surface. The dark attenuation rate is changeable in relation to, for instance, the wavelength and the exposure energy density of the first laser beam *3a*. In the preferred embodiment, the first laser beam *3a* has a wavelength of 780 nm and an exposure energy density of 1.5 μJ/cm², the dark attenuation rate is represented as exp. $-t/\tau_o$ ($\tau_o$=5.5 sec). The corona voltage of the second corona charger 5 is 6 KV so that the surface potential $V_{15}$ of the first exposed area E1 is 180 V after the second charge. The distance from the second charger 5 to the second developing unit 7 is about 176 mm so that the surface of the drum 1 is developed by the second developing unit 7 after 1 second has elapsed since the charge of the second charger 5 (because the peripheral speed of the drum 1 is 176 mm/sec). Accordingly, the surface potential $V_{17}$ at the second developing unit 7 is about 150 V.

When the surface potential $V_{17}$ is desired to be higher value, the corona voltage of the second corona charger 5 may be increased or the dark attenuation rate in the first exposed area E1 may be decreased by changing the wavelength and the exposure energy density of the first laser beam *3a*, for instance.

Figure 4:
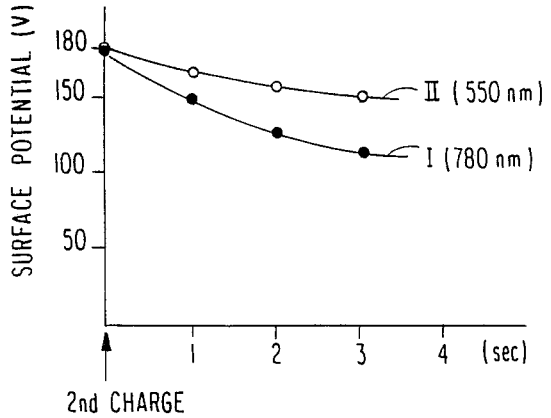
FIGS. 4 and 5 show dark attenuation of the surface potential in the first exposed area of the surface of the photoconductive drum used in the electrophotographic recording apparatus shown in FIG. 1.

FIG. 4 shows the dark attenuation of the surface potential in the first exposed area E1 after the second charge. Line I represents the attenuation when the first exposed area E1 has been exposed by a first laser beam whose wavelength is 780 nm and line II represents the attenuation when the area E1 has been exposed by a first laser beam whose wavelength is 550 nm. The exposure energy density thereof are the same, i.e., 1.5 μJ/cm². As apparent from the drawing, the dark attenuation of the potential in the area E1 becomes smaller when the wavelength of the first laser beam becomes shorter. Accordingly, one way to increase the surface potential $V_{17}$ of the first exposed area E1 during the second development is to shorten the wavelength of the first laser beam *3a*.

Figure 5:
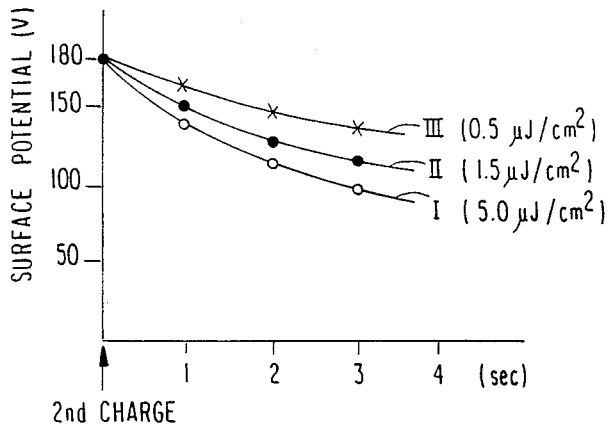

FIG. 5 also shows the dark attenuation of the surface potential in the first exposed area E1 after the second charge when the exposure energy density of the first laser beam is changed. Lines I, II and III represent the attenuation of the surface potential in the area E1 which has been exposed by the first laser beam whose exposure energy density is 5 μJ/cm², 1.5 μJ/cm² and 0.5 μJ/cm², respectively. The wavelength thereof are the same, i.e., 780 nm. The dark attenuation of the potential in the area E1 becomes smaller when the exposure energy density of the first laser beam becomes lower. Accordingly, the surface potential $V_{17}$ of the first exposed area E1 during the second development can also be adjusted by the exposure power of the first laser beam.

In the preferred embodiment, the color of the toners in the first and second developing units 4 and 7 are red and black. However, the other color can be utilized in the apparatus of the present invention.

What is claimed is:

1. An electrophotographic recording apparatus comprising:

a rotary photoconductive drum;

a first charger unit for uniformly charging a surface of said photoconductive drum to increase a surface potential of said photoconductive drum;

a first exposure unit for selectively exposing said surface of said photoconductive drum so as to decrease the surface potential in a first exposed area to form a first electrostatic latent image;

a first developing unit for developing said first electrostatic latent image with a first color toner to form a first visible image;

a second charger unit for recharging said surface of said photoconductive drum on which said first visible image is formed to increase the surface potential in said first exposed area to a first potential value;

a second exposure unit for selectively exposing said surface of said photoconductive drum so as to decrease the surface potential in a second exposed area to form a second electrostatic latent image, the surface potential in said second exposed area being a second potential value less than said first potential value; and a second developing unit for developing said second electrostatic latent image with a second color toner to form a second visible image, wherein said second developing unit is applied with a bias voltage $V_{B2}$ for adhering said second color toner to said second exposed area, said first potential in said first exposed area being in a range from 0.4 $V_{B2}$ to 0.8 $V_{B2}$ when said second electrostatic latent image is developed by said second developing unit.

2. An electrophotographic recording apparatus comprising:

a rotary photoconductive drum;

a first charger unit for uniformly charging a surface of said photoconductive drum to increase a surface potential of said photoconductive drum;

a first exposure unit for selectively exposing said surface of said photoconductive drum so as to decrease the surface potential in a first exposed area to form a first electrostatic latent image;

a first developing unit for developing said first electrostatic latent image with a first color toner to form a first visible image;

a second charger unit for recharging said surface of said photoconductive drum on which said first visible image is formed to increase the surface potential in said first exposed area to a first potential value;

a second exposure unit for selectively exposing said surface of said photoconductive drum so as to decrease the surface potential in a second exposed area to form a second electrostatic latent image, the surface potential in said second exposed area being a second potential value less than said first potential value;

a second developing unit for developing said second electrostatic latent image with a second color toner to form a second visible image;

a pre-transfer eraser lamp for discharging said surface of said photoconductive drum so that only said first and second visible images have a positive charge;

a paper web for transferring said first and second visible images thereto;

a transfer unit for supplying a negative charge to said paper web; and a cleaner for removing residual toner remaining on said surface of said photoconductive drum.

3. An electrophotographic recording apparatus comprising:

a rotary photoconductive drum;

a first charger unit for uniformly charging a surface of said photoconductive drum to increase a surface potential of said photoconductive drum;

a first exposure unit for selectively exposing said surface of said photoconductive form so as to decrease the surface potential in a first exposed area to form a first electrostatic latent image;

a first developing unit for developing said first electrostatic latent image with a first color toner to form a first visible image;

a second charger unit for recharging said surface of said photoconductive drum on which said first visible image is formed to increase the surface potential in said first exposed area to a first potential value;

a second exposure unit for selectively exposing said surface of said photoconductive drum so as to decrease the surface potential in a second exposed area to form a second electrostatic latent image, the surface potential in said second exposed area being a second potential value less than said first potential value; and a second developing unit for developing said second electrostatic latent image with a second color toner to form a second visible image, wherein said first potential value may be increased by increasing a voltage of said second charger unit.

4. An electrophotographic recording apparatus comprising:

a rotary photoconductive drum;

a first charger unit for uniformly charging a surface of said photoconductive drum to increase a surface potential of said photoconductive drum;

a first exposure unit for selectively exposing said surface of said photoconductive drum so as to decrease the surface potential in a first exposed area to form a first electrostatic latent image;

a first developing unit for developing said first electrostatic latent image with a first color toner to form a first visible image;

a second charger unit for recharging said surface of said photoconductive drum on which said first visible image is formed to increase the surface potential in said first exposed area to a first potential value;

a second exposure unit 6 for selectively exposing said surface of said photoconductive drum so as to decrease the surface potential in a second exposed area to form a second electrostatic latent image, the surface potential in said second exposed area being a second potential value less than said first potential value; and a second developing unit for developing said second electrostatic latent image with a second color toner to form a second visible image, wherein said first exposure unit comprises a laser beam and wherein said first potential value may be increased by shortening a wavelength of said laser beam of said first exposure unit.

5. An electrophotographic recording apparatus comprising:

a rotary photoconductive drum;

a first charger unit for uniformly charging a surface of said photoconductive drum to increase a surface potential of said photoconductive drum;

a first exposure unit for selectively exposing said surface of said photoconductive drum so as to decrease the surface potential in a first exposed area to form a first electrostatic latent image;

a first developing unit for developing said first electrostatic latent image with a first color toner to form a first visible image;

a second charger unit for recharging said surface of said photoconductive drum on which said first visible image is formed to increase the surface potential in said first exposed area to a first potential value;

a second exposure unit for selectively exposing said surface of said photoconductive drum so as to decrease the surface potential in a second exposed area to form a second electrostatic latent image, the surface potential in said second exposed area being a second potential value less than said first potential value; and a second developing unit for developing said second electrostatic latent image with a second color toner to form a second visible image, wherein said first exposure unit comprises a laser beam and wherein said first potential value may be increased by reducing an exposure energy density of said laser beam in said first exposure unit.

6. A process of forming a multi-color image on a surface of a photoconductive drum and transferring said multi-color image to a recording paper comprising the steps of:

uniformly charging a surface of said photoconductive drum to increase a surface potential of said photoconductive drum;

selectively exposing said surface of said photoconductive drum so as to decrease the surface potential in a first exposed area to form a first electrostatic latent image;

developing said first electrostatic latent image with a first color toner to form a first visible image;

recharging said surface of said photoconductive drum on which said first visible image is formed to increase the surface potential in said first exposed area to a first potential value;

selectively exposing said surface of said photoconductive so as to decrease the surface potential in a second exposed area to form a second electrostatic latent image, the surface potential in said second exposed area being a second potential value less than said first potential value; and developing said second electrostatic latent image with a second color toner to form a second visible image, wherein said step of developing said second electrostatic latent image includes applying a bias voltage $V_{B2}$ to a second developing unit, wherein said first potential value in said first exposed area is in a range from 0.4 $V_{B2}$ to 0.8 $V_{B2}$.

7. A process of forming a multi-color image on a surface of a photoconductive drum and transferring said multi-color image to a recording paper according to claim 6, further comprising the steps of:

discharging said surface of said photoconductive drum so that only said first and second visible images have a positive charge;

transferring said first and second visible images to a paper web by supplying a negative charge to said paper web; and removing residual toner remaining on said surface of said photoconductive drum.

8. The electrophotographic recording apparatus as claimed in claim 1, 2, 3, 4 or 5, wherein an electric charge of said first color toner is larger than that of said second color toner.

9. The electrophotographic recording apparatus as claimed in claim 1, 2, 3, 4 or 5, wherein said photoconductive drum has a photoconductive layer consisting of an amorphous silicon.

* * * * *

UNITED STATES PATENT AND TRADEMARK OFFICE

CERTIFICATE OF CORRECTION

PATENT NO. : 4,819,028

DATED : April 4, 1989

INVENTOR(S) : HIDEAKI ABE, Tokyo Japan

It is certified that error appears in the above-identified patent and that said Letters Patent is hereby corrected as shown below:

Column 4, line 31, delete ""0oo" and insert --"0"--.

Column 7, line 38, delete "form" and insert --drum--.

Signed and Sealed this

Sixteenth Day of January, 1990

*Attest:*

JEFFREY M. SAMUELS

*Attesting Officer*

*Acting Commissioner of Patents and Trademarks*